US010739014B2

(12) United States Patent
Schroeter et al.

(10) Patent No.: US 10,739,014 B2
(45) Date of Patent: Aug. 11, 2020

(54) SYSTEM AND METHOD TO COOL AN EXPOSED SURFACE OF AN APPLIANCE

(71) Applicant: Wolf Steel Ltd., Barrie (CA)

(72) Inventors: Wolfgang Schroeter, Oro-Medonte (CA); David Shulver, Richmond Hill (CA); Richard Tjart, Tiny (CA); Clifford N. Lilley, Anten Mills (CA)

(73) Assignee: Wolf Steel Ltd., Barrie (CA)

( * ) Notice: Subject to any disclaimer, the term of this patent is extended or adjusted under 35 U.S.C. 154(b) by 337 days.

(21) Appl. No.: 15/903,958

(22) Filed: Feb. 23, 2018

(65) Prior Publication Data

US 2018/0245793 A1 Aug. 30, 2018

Related U.S. Application Data

(60) Provisional application No. 62/463,415, filed on Feb. 24, 2017.

(30) Foreign Application Priority Data

Feb. 22, 2018 (CA) ..... 2995879

(51) Int. Cl.

| | |
|---|---|
| ***F24C 15/00*** | (2006.01) |
| ***F24H 3/00*** | (2006.01) |
| ***F24C 3/00*** | (2006.01) |
| ***F24C 3/02*** | (2006.01) |
| ***F24B 1/188*** | (2006.01) |
| ***F24C 15/04*** | (2006.01) |

(52) U.S. Cl.

CPC ..... *F24C 15/006* (2013.01); *F24B 1/1885* (2013.01); *F24C 3/004* (2013.01); *F24C 3/025* (2013.01); *F24C 15/04* (2013.01); *F24H 3/00* (2013.01)

(58) Field of Classification Search

CPC ..... F24C 15/006

See application file for complete search history.

(56) References Cited

U.S. PATENT DOCUMENTS

| | | | | |
|---|---|---|---|---|
| 4,422,436 | A * | 12/1983 | Chamberlain | F24B 5/023 110/180 |
| 4,520,791 | A * | 6/1985 | Chamberlain | F24B 5/023 126/198 |
| 5,337,727 | A | 8/1994 | Borens et al. | |
| 5,542,407 | A * | 8/1996 | Hawkinson | F24B 1/1808 126/193 |
| 6,019,099 | A | 2/2000 | Shimek et al. | |
| 6,848,441 | B2 | 2/2005 | Bachinski et al. | |
| 6,904,904 | B2 | 6/2005 | Walther et al. | |

(Continued)

OTHER PUBLICATIONS

Canadian Patent Office Action dated Apr. 29, 2019 for CA2,995,879.

(Continued)

*Primary Examiner* — David J Laux

(74) *Attorney, Agent, or Firm* — Honigman LLP

(57) ABSTRACT

An appliance comprising a firebox, a first air duct and a room air chimney. During operation of the appliance heated room air adjacent to a viewing pane or the screen and heated room air from the first air duct is received within the chimney. The heated air within the chimney rises toward an open upper end causing the chimney to draw additional room air from adjacent to the viewing pane or screen.

21 Claims, 8 Drawing Sheets

(56) References Cited

U.S. PATENT DOCUMENTS

| | | | | |
|---|---|---|---|---|
| 7,422,011 | B2 * | 9/2008 | Bachinski | F24B 1/1808 126/110 E |
| 8,978,639 | B2 * | 3/2015 | Halverson | F24C 15/001 126/523 |
| 9,097,427 | B2 * | 8/2015 | Binzer | F24C 3/006 |
| 2005/0139209 | A1 * | 6/2005 | Deng | F24C 15/006 126/512 |
| 2007/0044790 | A1 * | 3/2007 | Carlo | F24B 1/1808 126/512 |
| 2015/0219339 | A1 * | 8/2015 | Maxson | F24B 1/1885 126/523 |
| 2018/0224130 | A1 * | 8/2018 | Lee | F24C 15/00 |

OTHER PUBLICATIONS www.valorfireplaces.com/features/heatshift.php, Mar. 6, 2018.
www.regency-fire.com/Products/gas/designer-gas-fireplaces, Mar. 6, 2018.
www.montigo.com/about, Mar. 6, 2018.
Kingsman VRB46 Direct Vent Gas Fireplace Brochure.
Kingsman VRB46 Installation Instructions Printed Dec. 15, 2017.

* cited by examiner

SYSTEM AND METHOD TO COOL AN EXPOSED SURFACE OF AN APPLIANCE

FIELD

This invention relates generally to heating, hearth or similar appliances, and in particular to a system and a method to cool an exposed surface of an appliance.

BACKGROUND

Stand-alone heating appliances are typically used as either sources of heat and/or for primarily decorative or aesthetic purposes. They are most commonly comprised of natural gas or propane burning fireplaces or stoves, or wood or coal burning fireplaces or stoves. Such appliances present the ability for localized heating, as well as the often desirable ambiance of a burning flame. A significant percentage of modern day fireplaces and stoves that are installed are of the direct vent type, wherein the firebox is sealed from the room within which the appliance is installed and combustion air is drawn from an outside environment. Direct vent fireplaces and stoves typically include at least one transparent (or largely transparent) external pane or surface (typically a front and/or end surface) to permit viewing of the interior of the firebox. These transparent panes or surfaces not only assist in sealing the firebox to allow for the proper functioning of a direct vent appliance, but also serve as a safety barrier preventing contact with the interior of the firebox. In the case of a natural vented fireplace or stove (sometimes referred to as "B-vent" appliances) there may at times be installed on one or more sides of the appliance a transparent pane to help prevent contact with the interior of the firebox. In some cases, a wire mesh or screen may be utilized, while in still other instances a combination of a transparent pane and a wire mesh or screen may be employed to achieve a particular desired visual effect. Non-vented appliances may also have incorporated into one or more of their sides a transparent pane and/or a screen.

Regardless of the nature of the appliance at hand, the presence of a transparent pane, a screen, or a combination of a transparent pane and a screen on one or more exposed sides or surfaces of the appliance can fulfill both functional and aesthetic requirements. At the same time, such structures can present a potential safety hazard. When heat generating appliances are in operation, such transparent panes or screens can become heated to a degree significant enough to cause burns should an individual, pet, or object come into contact with them. In some jurisdictions regulations have been passed limiting the temperature to which these components can be heated during operation of the appliance.

In an attempt to help regulate the heating of exposed components or surfaces of a fireplace, stove or other such appliance, others have proposed the use of multiple panes of transparent material, offset by airspaces to provide a degree of thermal insulation. In addition, it has been suggested to direct air from an electric fan over exposed surfaces for a cooling effect. While such approaches have been somewhat successful in helping to limit the temperature of transparent panes or screens on the sides of the appliance, at times they can result in increased installation, manufacturing, and/or operating costs. Where existing solutions rely upon an electrically driven motor to operate a cooling fan, they not only impact manufacturing, installation and operating costs, but lose their effectiveness in the case of a power outage.

SUMMARY

In one embodiment the invention provides an appliance comprising a firebox having a top, a bottom and a plurality of side surfaces, at least one of said side surfaces including at least one of a viewing pane, a screen, or a side panel; a first air duct in fluid communication with at least a portion of said top surface of said firebox, said first air duct defined in part by at least a portion of said top surface of said firebox; and a room air chimney in fluid communication with said first air duct and extending along at least part of the length of the firebox, the chimney having at least a partially open lower end and at least a partially open upper end with enclosed sides extending therebetween, at least a portion of said lower end in fluid communication with one or both of said first air duct and heated room air adjacent to said at least one viewing pane, screen, or side panel such that heated air within said first air duct rises and is received within said chimney and heated air adjacent to said at least one viewing pane, screen, or side panel rises and is received within (i) said first air duct and then said chimney, or (ii) directly into said chimney, wherein, during operation of said appliance heated air adjacent to said at least one viewing pane, screen, or side panel, and heated room air from said first air duct, is received within said chimney, said heated air within said chimney rising toward said open upper end causing said chimney to draw additional air from adjacent to said at least one viewing pane, screen or side panel and into said first air duct.

In another embodiment the invention provides a method to cool an exposed surface of an appliance having a firebox with a top, bottom and a plurality of side surfaces, at least one side surface enclosed by a first viewing pane having a second viewing pane located a predetermined distance from the first viewing pane forming a first air flow passage between said viewing panes, the method comprising during operation of the appliance, heating the top surface of the firebox to cause a resulting heating of air in a first air duct in fluid communication with the top surface of the fireplace; directing heated air rising under the influence of gravity within the first air duct to a room air chimney in fluid communication with the first air duct and extending along at least part of the length of the firebox; drawing room air through the first air flow passage into (i) the first air duct and then subsequently into the chimney, or (ii) directly into the chimney; and utilizing heat extracted from the viewing panes by passing air through the first air flow passage and utilizing heat extracted by air passing through said first air duct to accelerate the flow of air through the chimney thereby generating a chimney effect to enhance the draw of air through the first air flow passage.

In a further embodiment the invention provides a direct vent fireplace or stove comprising a firebox having a top, a bottom and a plurality of side surfaces, at least one of said side surfaces comprising a transparent first viewing pane; a second viewing pane set off from said first viewing pane and defining a first air flow passage between said viewing panes; a first air duct in communication with at least a portion of said top surface of said firebox, said first air duct defined in part by said top surface of said firebox and in fluid communication with said first air flow passage; and a room air chimney in fluid communication with said first air duct and extending along at least part of the length of the firebox, the chimney having at least a partially open lower end and at least a partially open upper end with enclosed sides extending therebetween, at least a portion of said lower end in fluid communication with one or both of said first air duct and said first air flow passage such that heated air within said first air flow passage rises and is received within (i) the first air duct and then the chimney, or (ii) directly into the chimney, wherein, during operation of said appliance heated air from said first air flow passage is received in said first air duct and heated air from said first air duct is received within said chimney, said heated air within said chimney rising toward said open upper end and causing said chimney to draw additional air through said first air flow passage.

In still a further embodiment the invention provides an appliance comprising a firebox having a top, a bottom and a plurality of side surfaces, at least one of said side surfaces including at least one of a viewing pane, a screen, or a side panel; a first air duct in communication with at least a portion of said top surface of said firebox, said first air duct isolated from gases within said firebox and having a lower portion defined in part by said top surface of said firebox, said first air duct further having an upper surface defined by a plate with at least one opening therein to permit heated air within said first air duct to rise and escape at a defined location, said lower portion of said first air duct including at least one opening to permit heated air rising and flowing along said at least one viewing pane, screen or side panel into enter said first air duct, wherein, in operation said appliance is situated within a framed enclosure within in a room, wherein that portion of said framed enclosure positioned above said first air duct comprises a room air chimney such that heated air within said first air duct rises, passes through said opening in said plate and into said room air chimney, and wherein, during operation of said appliance heated air adjacent to said at least one viewing pane, screen, or side panel, and heated air from said first air duct, is received within the framed enclosure, said heated air within the framed enclosure rising upward within the enclosure creating a chimney effect resulting in a draw of additional air from adjacent to said at least one viewing pane, screen or side panel and into the framed enclosure.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

Figure 1:
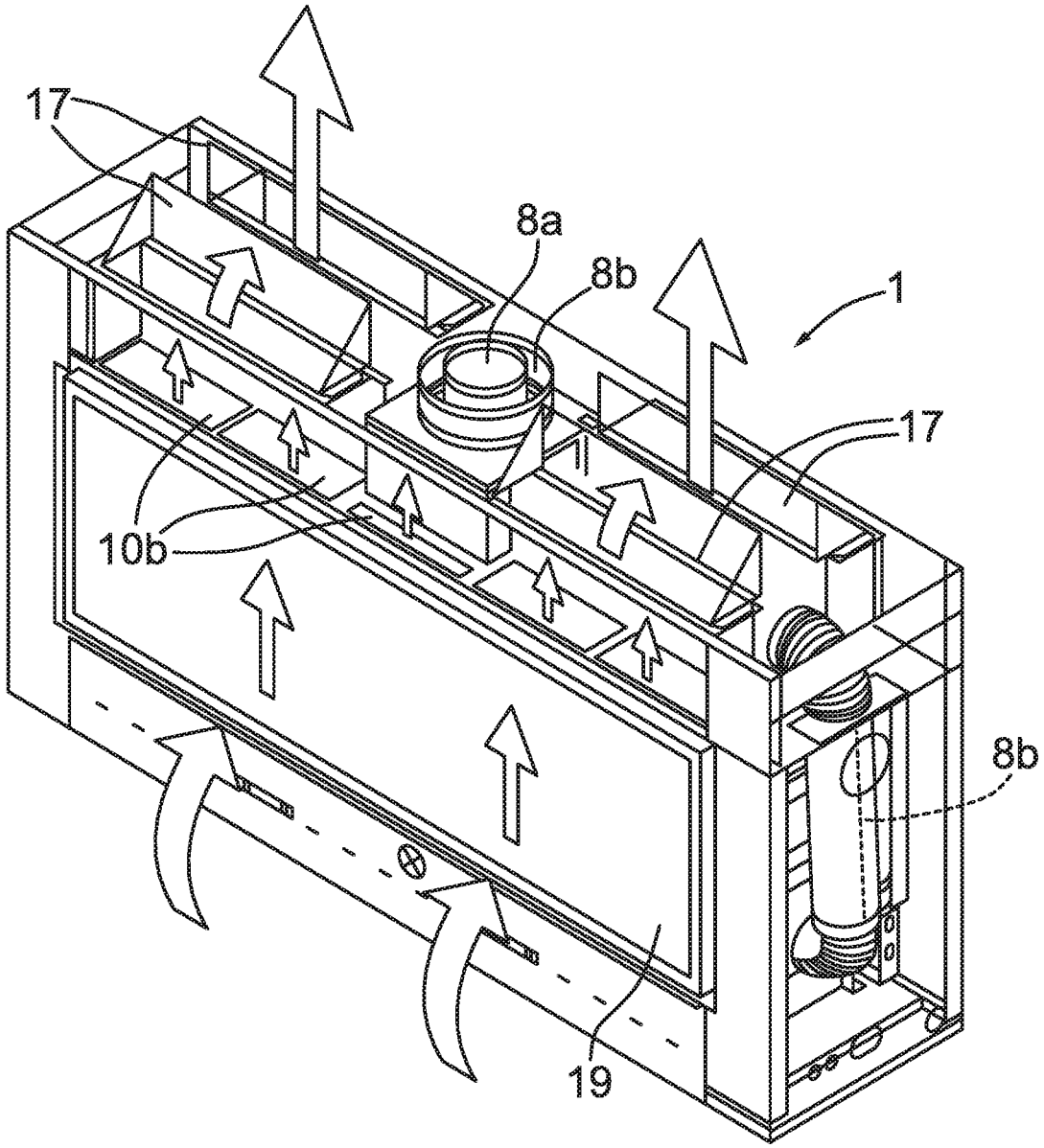
FIG. 1 is an upper front transparency perspective view of a typical direct vent fireplace employing an embodiment of the present invention.
Figure 2:
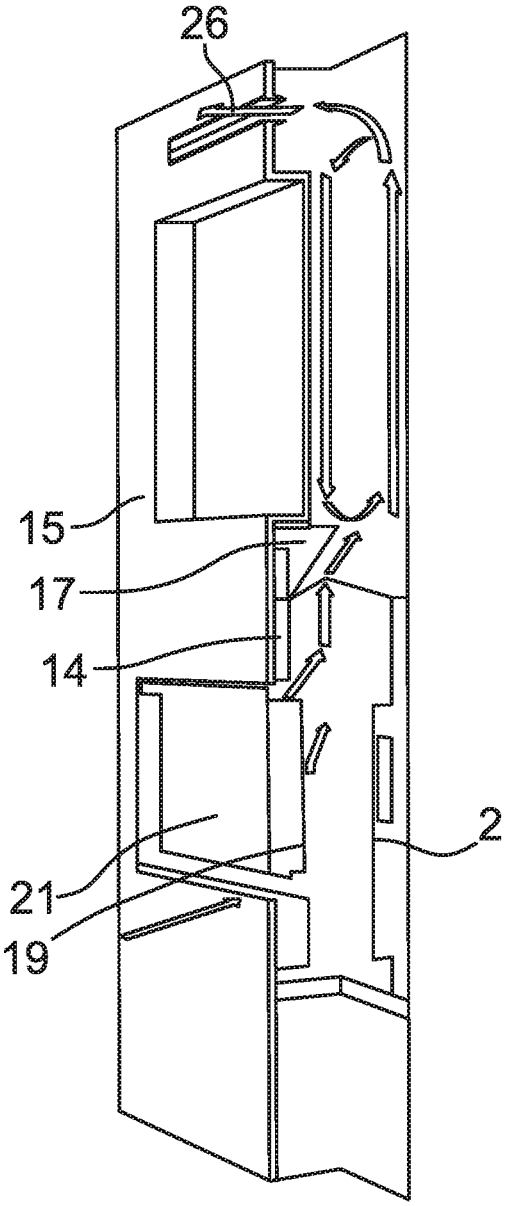
FIG. 2 is a side perspective cut away view of a typical framed enclosure housing a direct vent fireplace that employs an embodiment of the present invention.
Figure 3:
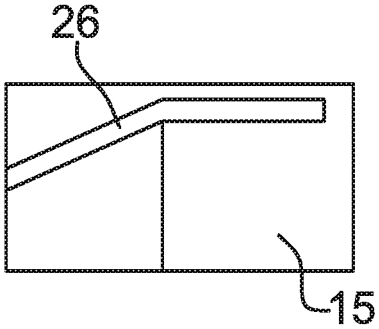
FIG. 3 is a detail view of the upper portion of an alternate framed enclosure to that shown in FIG. 2.
Figure 4:
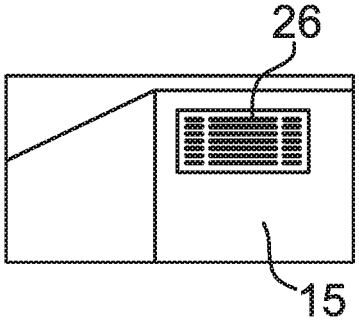
FIG. 4 is a detail view of the upper portion of an alternate framed enclosure to that shown in FIGS. 2 and 3.
Figure 5:
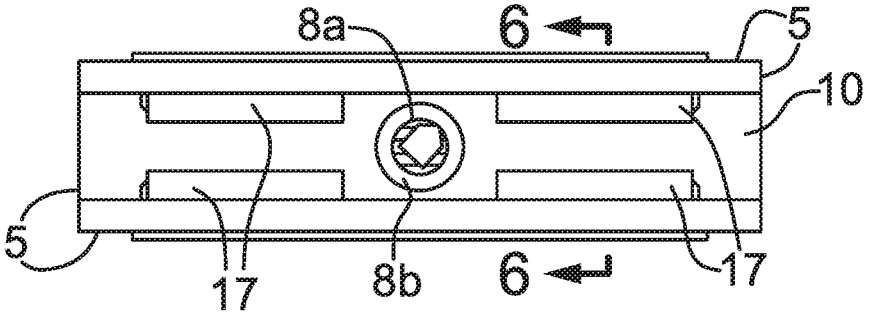
FIG. 5 is a plan view of a fireplace employing an embodiment of the present invention

The present invention may be embodied in a number of different forms. The specification and drawings that follow describe and disclose some of the specific forms of the invention.

With reference to the attached drawings, there is shown an appliance that in the particular embodiments depicted, is a gas fireplace 1. It should be noted that other forms of appliances could equally be encompassed within the invention, as well as other forms of fireplaces or stoves, including electric, wood burning, coal burning and pellet burning fireplaces and stoves. Further, whereas in the attached drawing fireplace 1 is a direct vent fireplace, the invention equally applies to naturally vented fireplaces, stoves and appliances.

Fireplace 1 is comprised generally of a firebox 2 having a top surface 3, a bottom surface 4, and a plurality of side surfaces 5. Where, as in the case of the attached drawings, the fireplace is a direct vent gas fireplace, the fireplace will further include a burner 6, a gas valve 7, an exhaust duct 8*a* and a combustion air intake duct 8*b*. In other instances the "firebox" could comprise another form of "heating chamber" in an appliance. Commonly, one or more of side surfaces 5 of firebox 2 will be comprised of or contain a transparent or generally transparent viewing or window pane 19 commonly formed from a high temperature glass. Viewing pane 19 not only serves to allow the interior flame within the firebox to be viewed from the room within which the fireplace is situated, but also serves to seal the firebox to enable a direct vent operation. For aesthetic purposes, a metal or wire screen may be placed adjacent to viewing pane 19. As will be discussed in further detail below, in some instances viewing pane 19 may be comprised of two, three, or more independent viewing panes arranged in a relatively close side by side relationship. Alternately, one or more of side surfaces 5 maybe comprised of one or more, or various combinations of, a screen, a side panel and/or one or more viewing panes. In the case of a naturally vented or a non-vented fireplace, stove or appliance, commonly a metal or wire screen is situated across the open side or sides of the firebox, with or without a transparent pane.

In accordance with the invention, there is further provided a first air duct 10 extending across at least a portion of the top surface 3 of firebox 2. Typically, first air duct 10 will be generally rectangular and box-like in nature and will generally extend across the top of the firebox, across at least a portion of the firebox, or across the top of the firebox to the extent permissible to accommodate other mechanical structures that may be present, including exhaust and intake ducts 8*a* and 8*b*. First air duct 10 is isolated from the interior of firebox 2 and will not receive combustion air or combustion by-products, however, its close proximity to the top of the firebox will result in a heating of air within it. The upper surface of first air duct 10 is defined by a generally horizontal plate 10*a*. Within plate 10*a* are situated one or more openings 10*b* that permit heated air within first air duct 10 to rise and escape from duct 10 at a defined location or defined locations.

The lower surface of first air duct 10 may be largely defined by the exterior of the top surface 3 of firebox 2. As will be understood from an examination of FIGS. 6A and 6B, at least a portion of first air duct 10 may extend outwardly from the central portion of the fireplace or appliance beyond top surface 3 and effectively "overhang" the one or more side panels, screens or viewing panes that form side surface or side surfaces 5. The lower surface of first air duct 10 that extends outwardly in this fashion may thus include one or more openings 10*c* that permit the flow of room air from along and/or between the one or more side panels, screens or viewing panes into first air duct 10.

Figure 6A:
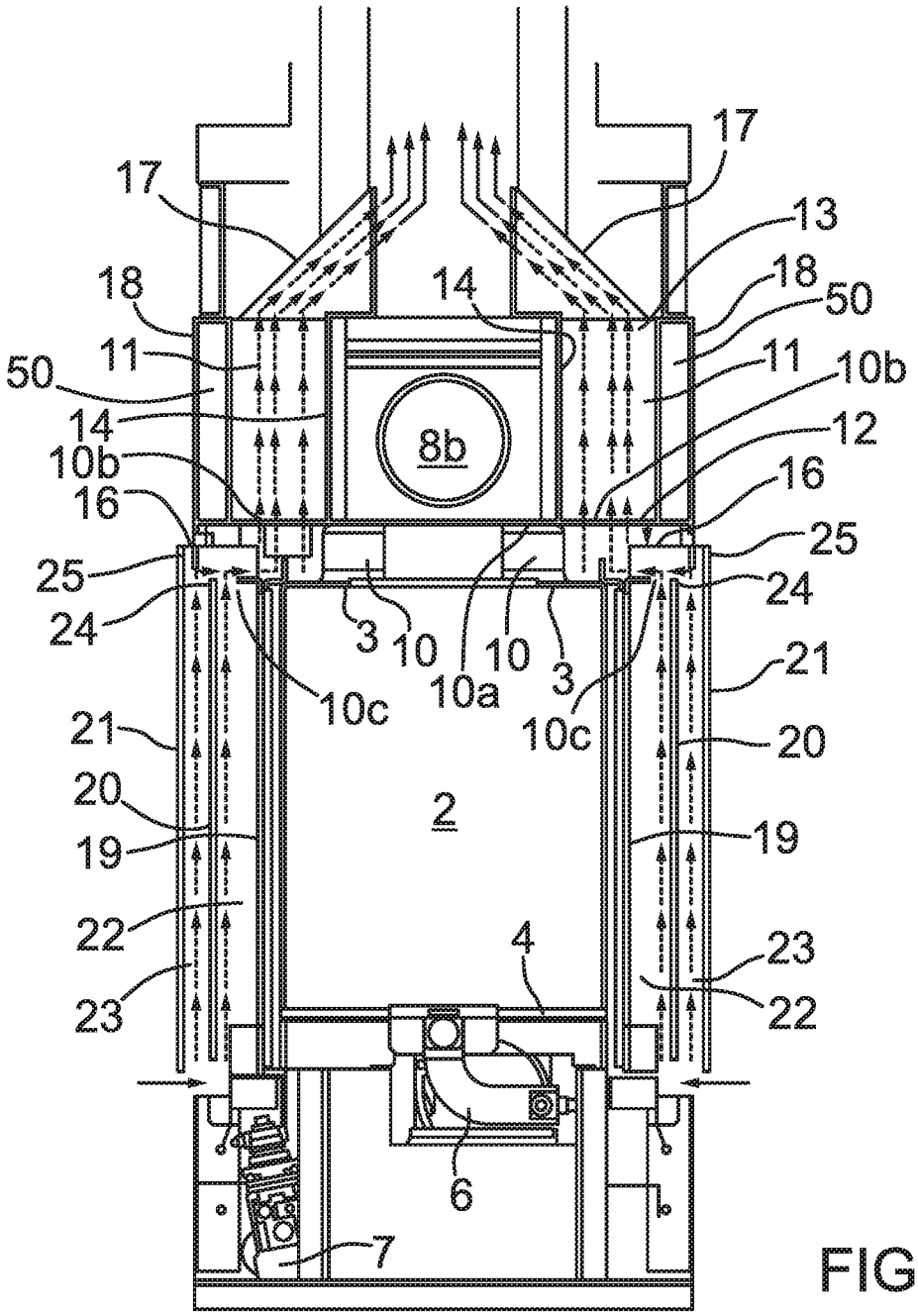
FIG. 6A is a vertical sectional view along the line 6-6 of FIG. 5, showing a double sided direct vent fireplace employing an embodiment of the present invention.

In the embodiment shown in FIGS. 1, 5 and 6A and 6B, fireplace 1 is a double sided fireplace with window panes 19 situated on each side. The embodiment of FIG. 6A is substantially similar to the embodiment of FIG. 6B except that in FIG. 6B there is utilized an outer screen 30, whereas in FIG. 6A transparent viewing panes are present. As shown in each Figure, first air duct 10 may extend across or substantially across the entire depth of the fireplace, effectively spanning the firebox from one window pane to the other. In embodiments comprising a double sided fireplace a dedicated first air duct may be situated along each side of the firebox.

In an embodiment, the invention further provides a room air chimney or chimney enclosure 11 in fluid communication with first air duct 10. In the embodiments show in the attached drawings, chimney 11 is positioned generally above first air duct 10 and extends laterally along the top of firebox 2 in the direction of viewing pane 19. Other embodiments and configurations of chimney 11 are possible. Chimney 11 is generally parallel to the upper edge of viewing pane 19 and has a generally open lower end 12 and a generally open upper end 13 with enclosed sides 14 extending between the upper and lower ends. Typically sides 14 will form a rectangular box-like chimney structure that runs largely or substantially along the length of the firebox above and generally parallel to pane 19. The depth of chimney 11 will most commonly be less than its height such that the height to depth ratio of the chimney enclosure will be greater than 1. Side 18 forming the outer surface of the chimney enclosure (ie that surface most interior to the room) may be insulated to help reduce heat transmission to the framed enclosure 15 that houses fireplace 1. In one embodiment, insulating side 18 can be accomplished by utilizing a double wall construction (within or without interior insulation) creating a chamber 50 in the outer side of the chimney enclosure. As will be appreciated from a review of the description that follows, insulating side 18 adjacent to framed enclosure 15 also serves to retain heat within chimney 11 which aids in the function of the chimney enclosure. In a further embodiment, all of the sides of chimney 11 may be insulated as may be combustion air intake 8*b*.

In an embodiment of the invention chimney 11 is an integral part of the upper portion of the fireplace or appliance. In an alternate embodiment, the fireplace or appliance is positioned within a framed enclosure with that portion of the framed enclosure positioned above first air duct 10 effectively comprising the chimney enclosure. That is, as will be apparent from an understanding of the description of the invention set out below, in one embodiment, the interior of the framed enclosure within which the fireplace or appliance is received or installed can function as chimney 11 without necessarily a need for a separate and dedicated chimney enclosure as a feature incorporated into the top portion of the fireplace or appliance. In that embodiment, heated air will rise from first air duct 10 through opening or openings 10*b* and into the framed enclosure, which will act as chimney 11. It will further be appreciated that is this embodiment, there is a potential to adjust or influence the "chimney effect" created by heated air rising within the framed enclosure through the utilization of a plurality of openings 10*b* and through opening or sealing some of those openings, or alternately through partially opening or partially closing some or all of openings 10*b*. In still a further embodiment of the invention the framed enclosure my operate as a chimney enclosure and there may also be present a dedicated chimney 11 that is an integral part of the upper portion of the fireplace or appliance.

Figure 6B:
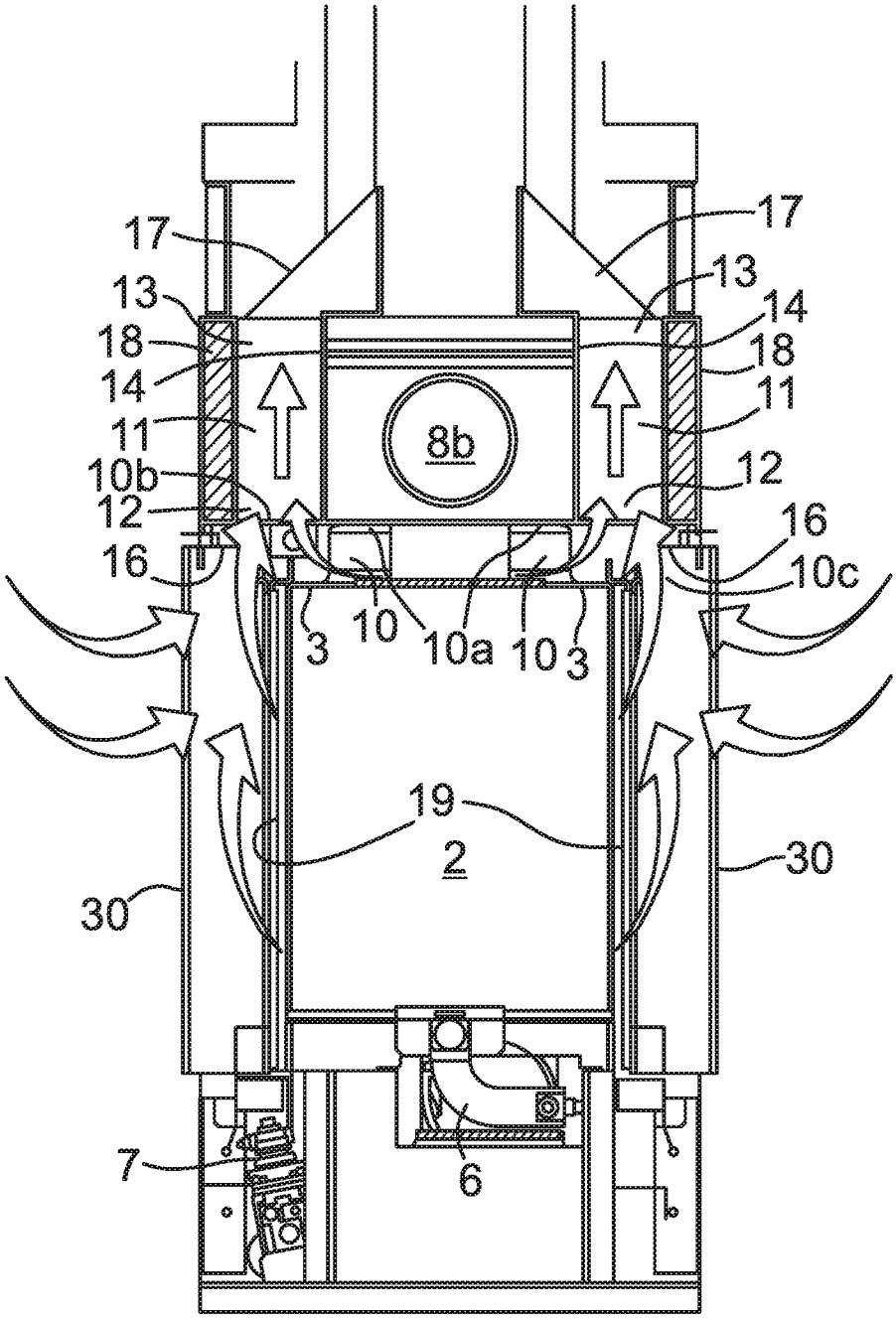
FIG. 6B is a view similar to FIG. 6A wherein the fireplace has an exterior screen.
Figure 7F:
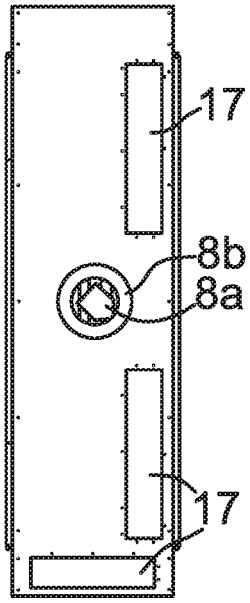
FIGS. 7A through 7H are plan views of fireplaces employing alternate embodiments of the present invention.
Figure 7G:
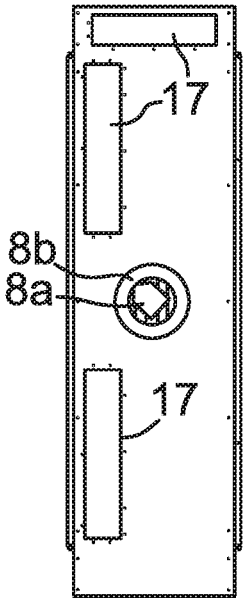
Figure 7H:
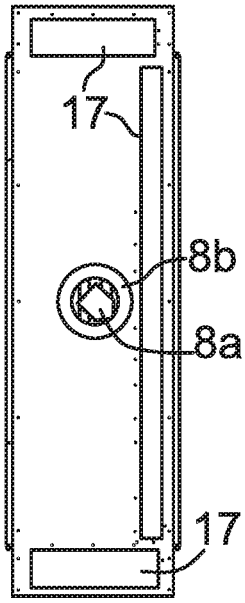
Figure 7C:
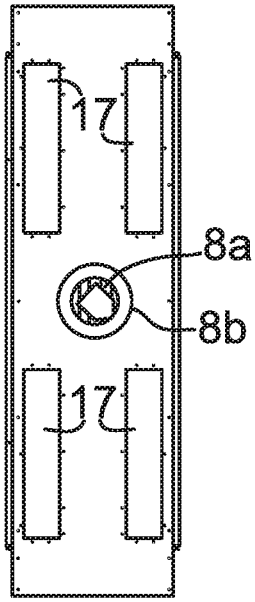
Figure 7D:
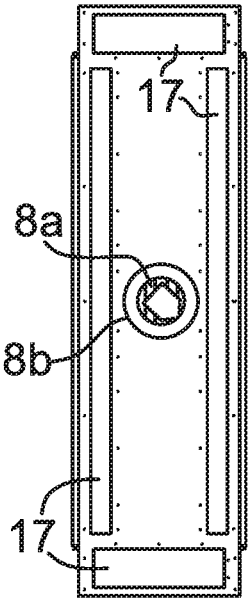
Figure 7E:
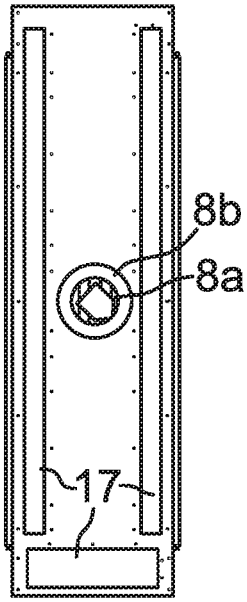
Figure 7A:
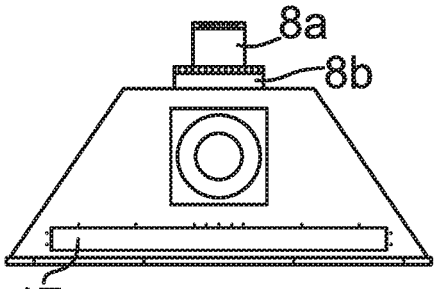
Figure 7B:
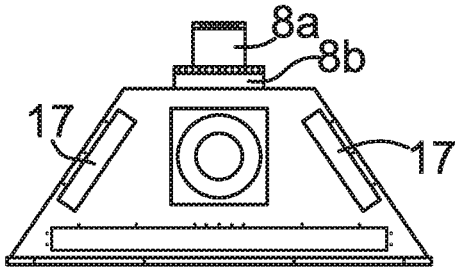

With particular reference to FIGS. 6A and 6B, in the depicted embodiment it will be noted that at least a portion of lower end 12 of chimney 11 is in fluid communication with first air duct 10 such that heated room air within first air duct 10 rises, moves through opening or openings 10*b*, and is received within chimney 11. That is, during operation of fireplace 1, heat from the firebox will heat first air duct 10 and the air within the duct. As that air is heated it will tend to rise through opening or openings 10*b* into chimney 11. Similarly, as room air adjacent to viewing pane 19 becomes heated, it will tend to rise and will be directed through opening or openings 10*c* into lower end 12 of chimney 11. To assist in directing warm air rising adjacent to viewing pane 19 into the chimney enclosure a horizontal baffle 16 may be positioned above the viewing pane (either within or immediately below first air duct 10). Baffle 16 preferably runs generally along the length of the fireplace or firebox and terminates at its interior edge at or near the transition between first air duct 10 and lower end 12 of chimney 11. A portion of the chimney enclosure may straddle the inner end of the baffle to a degree. Heated air that rises along the viewing pane will thus contact baffle 16, travel along the baffle and, once it has cleared the interior edge of the baffle, proceed into direct air duct 10 and then into chimney 11. Depending on the relative positions of baffle 16, lower end 12 of chimney 11, and first air duct 10, the heated air from adjacent viewing pane 19 may be received directly into the chimney after clearing the interior end of baffle 16.

Heated air entering chimney enclosure 11 will rise upwardly through the chimney enclosure creating what is known in the industry as a "chimney effect". That is, the movement of the stream of heated air entering lower end 12 of chimney 11 will tend to accelerate as the air rises within the chimney enclosure in an upward direction. The continued operation of the firebox will further heat the air that is received within chimney 11 and will tend to increase the rate of flow through the enclosure. The heating of the air and its accelerated movement upwardly through chimney 11 has the effect of creating an increased "draw" of room air along or adjacent to viewing pane 19 and ultimately into chimney 11.

The particular path of air flow is shown by means of the arrows in FIGS. 1, 6A and 6B. It will be note that the flow of air is directed along portions of the surfaces of fireplace 1 that are heated during operation. That is, where a transparent viewing pane is present at least some of the air may first travel along the viewing pane and is heated (as in FIG. 6A). Where a screen 30 is utilized (as in FIG. 6B) the air can both travel along inner pane 19 and will also to a degree be drawn through the screen. The air then picks up additional heat from first air duct 10 (when it is directed through duct 10) and also from the side surfaces of chimney 11, which are themselves heated during operation of the fireplace. The net effect is that the air flow captures heat from both the viewing window and the top of the fireplace. In this manner the air is heated to a degree greater than it would be if drawn across viewing pane 19 only. The increased heating of the air enhances the "chimney effect" within chimney 11, that in turn enhances the draw of air adjacent viewing pane 19. The flow of air into chimney 11 is also along a relatively smooth pathway creating a relatively low degree of turbulence, further enhancing the "draw" that is created.

As the heated air travels upwardly through the chimney it eventually exits upper end 13 at a position that will typically be within the upper portion of the framed enclosure 15 within which fireplace 1 is situated. Framed enclosure 15 will often be comprised of wooden or metal studs to which drywall or other wall covering materials are secured. Air flow guides 17 may be positioned at upper end 13 of chimney 11 in order to deflect or guide the heated air that exits upper end 13 of chimney 11 toward the central portion of framed enclosure 15 and away from the exterior wall of the enclosure (ie in a direction away from the plane of viewing pane 19). It is expected that in most instances air flow guides 17 will extend along the entire length of chimney 11, however in some instances the air flow guides may be discontinuous or may be truncated, in terms of their extension toward the central portion of the framed enclosure 15, to account for other structures, (fireplace venting and/or combustion air venting, etc). The exterior wall of enclosure 15 would typically be comprised of combustible material, or may have mounted on it a temperature sensitive object (e.g. television, clock, art work, etc.). It has been found that the use of air flow guides 17 helps to deflect heated air away from the exterior wall of enclosure 15 to the extent that the wall can safely be formed from combustible products and so as to prevent damage or undue heating of objects that may be mounted upon the outside of the wall. The net effect is the prevention of an undue or excessive heating of the exterior wall of enclosure 15 that could cause a fire or heat related damage.

As mentioned, multiple viewing panes may be utilized at a side of the fireplace. In the embodiment shown in FIG. 6A, three such panes are present. The innermost pane 19 comprises glass that seals the fireplace in a direct vent application. The intermediate pane 20 and the exterior pane 21 are commonly positioned parallel to innermost pane 19, effectively creating a first air flow passage 22 and a second air flow passage 23. The upper portion of exterior pane 21 is preferably "sealed" to the outer edge of baffle 16. By "sealed" in this context, one of ordinary skill in the art will appreciate that pane 21 need not necessarily be tightly "sealed" to the outer edge of baffle 16. Depending on the design of the appliance, the heat generated, etc, pane 21 may be "sealed" to baffle 16 by a sealant, through the use of an insulating material, by generally abutting the components together, or in some cases by simple placing pane 21 sufficiently close to baffle 16 so as to prevent an undue amount of air to be drawn into chimney 11 through the gap between pane 21 and baffle 16.

One or more of the viewing panes may include a "low e" or other such coating to help trap radiant heat within one or both of air flow passages 22 and 23. The upper surface 24 of intermediate pane 20 is preferably off-set from horizontal baffle 16 to permit the smooth flow of heated air within air flow passage 23 into first air duct 10 or directly into chimney 11, once again depending on the particular configuration of the air duct and the chimney. The lower ends of each of intermediate and exterior panes 20 and 21 are open to room air. In this manner, during operation of the fireplace air within air flow passages 22 and 23 is heated and rises upwardly, to be directed into either first air duct 10 or chimney 11. Room air immediately adjacent to the most exterior pane or appliance surface may also be drawn into first air duct 10 without travelling through a dedicated air flow passage formed between two adjacent surfaces. In the case of air flow passages 22 and 23, it will be appreciated that as air within air flow passages 22 and 23 rises, room intake air is drawn into the bottom of each passage. A continued heating of the air within air flow passages 22 and 23, and within first air duct 10, through operation of the fireplace, tends to accelerate the movement of air through the chimney causing the fireplace to draw an increased volume of room intake air through the open bottoms of passages 22 and 23 (and potentially along the most outer exterior pane or surface of the appliance). The "chimney effect" created through heating and continued operation of the fireplace helps to enhance and maintain the draw of intake air into passages 22 and 23. It will be appreciated that the temperature of the intake air that is drawn into passages 22 and 23 will in many cases be lower than the temperature of innermost pane 19, and in a number of cases intermediate and exterior panes 20 and 21. The movement of lower temperature room air through passages 22 and 23 may thus help to cool panes 19, 20 and 21. It will, of course, be appreciated that where only two viewing panes are used there will be in an inner and an outer pane with a single air flow passage therebetween. In that embodiment air will be drawn into chimney 11 through the single air flow passage, thereby exhibiting a general tendency to help to cool the inner and outer panes forming the single air flow passage. Similarly, three or more air flow passages may be utilized by incorporating additional viewing panes into the fireplace design.

In a typical appliance/fireplace the glass or outer surface tends to get hot. Convective air travels upwardly along the exterior/pane and tends to "pool" near the top of the appliance, eventually spilling out of the front to wash up the wall surface above the appliance/fireplace. As a result, temperature sensitive finishes and equipment must often be spaced apart from the top of the appliance and non-combustible materials must typically be used to enclose or frame around the appliance. The invention helps to redirect the heat and avoid such pooling of heated air by means of the chimney effect that is created. This redirecting of the heat emanating from the firebox and/or viewing pane(s) and/or exterior surface to an alternate location helps to keep the outer surface of the appliance cooler, allowing for the use non-combustible materials. Additionally the defined air flow path helps to avoid an overheating of material or equipment above the front of the appliance/fireplace.

It will further be appreciated that while in the described embodiment viewing panes 19, 20 and 21 are said to be parallel to one another, in an alternate embodiment one or more could be non-parallel. In that regard it has been discovered that sloping the panes relative to one another such that they converge in a direction toward their upper ends, causing the air flow passage between adjacent panes to get progressively narrower toward the top of the panes, can accelerate air flow and create a chimney effect that tends to enhance or accelerate the draw of air upwardly between the panes. It will also be appreciated that a variety of different number of panes and combinations of sloped panes could be utilized. For example, where two panes are used, one or both of the panes could be sloped to cause a narrowing of the resulting air flow passage. Where three panes are used one or more of the panes could be sloped to cause a narrowing of one or both of the resulting air flow passages.

As mentioned, in the embodiment of the invention shown in FIG. 6A, fireplace 1 is a double sided fireplace having glass panes 19, 20 and 21 on each side. Each side of the fireplace will thus also include first and second air flow passages 22 and 23 that direct heated air that rises within the passages into the lower end 12 of a chimney 11 or into first air duct 10 that is situated above each of the respective sides of the fireplace. Each chimney 11 will also typically be fitted with an airflow guide 17 to encourage the flow of heated air toward the middle portion of framed enclosure 15 within which fireplace 1 is housed. Typically, the primary physical components of the invention and the flow of heated air described above on one side of fireplace 1 will be the mirror image of that on the other. In the case of a double sided fireplace, a single first air duct 10 may be positioned above the top surface 3 of the firebox 2 with that single first air duct directing heated air to chimneys on each side of the fireplace. In other cases, a separate and dedicated first air duct 10 may be positioned on each of the respective sides of the fireplace. FIGS. 7A through 7H depict alternate variations of fireplace shapes and the positioning of viewing panes on different side surfaces of a fireplace, demonstrating the resulting effect on the structure of the invention.

Figure 8:
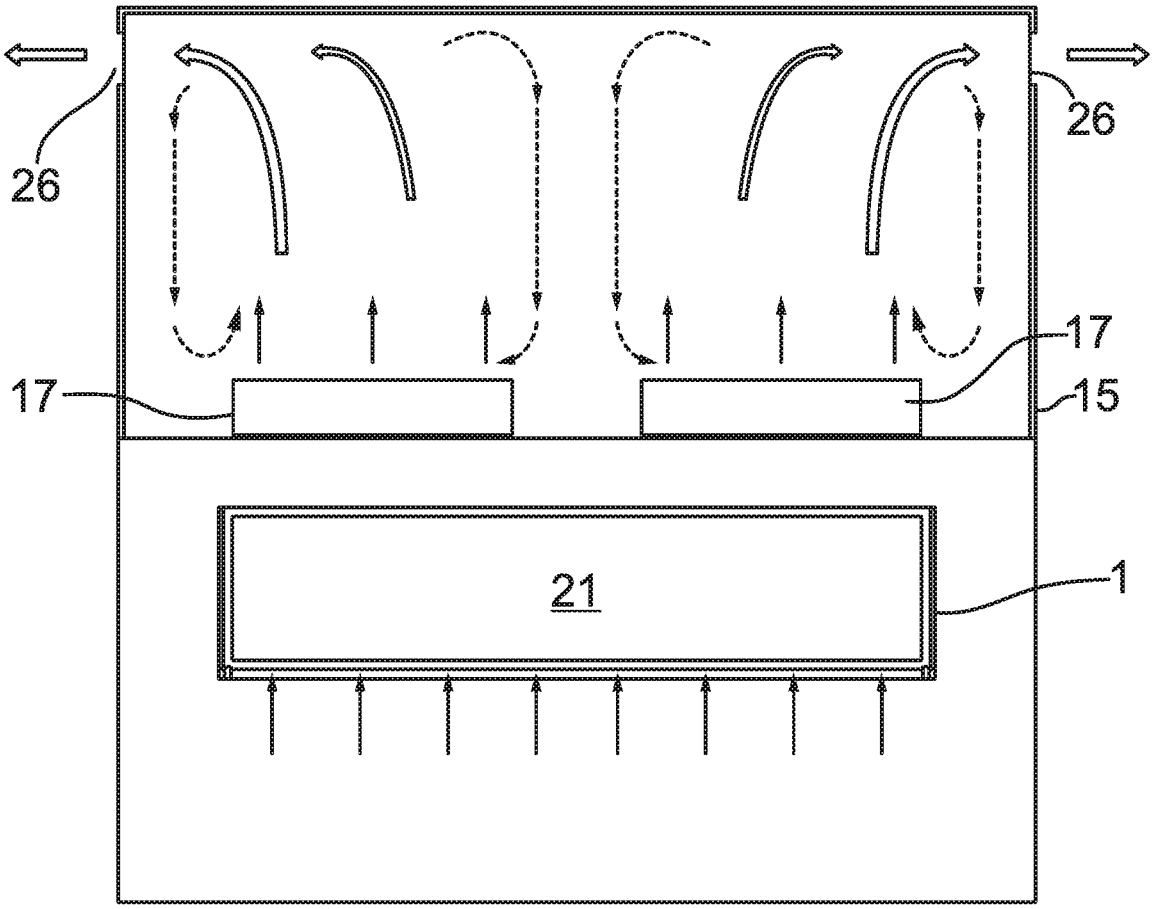
FIG. 8 is a front view of a framed enclosure housing a fireplace employing an embodiment of the present invention wherein a portion the enclosure has been removed to demonstrate air flow.
Figure 9:
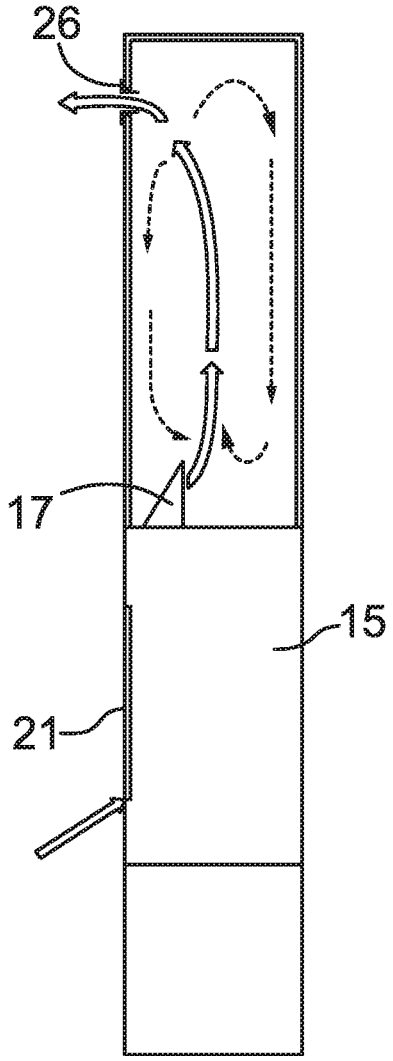
FIGS. 9 and 10 demonstrate schematically the air flow through a framed enclosure housing a fireplace employing an embodiment of the present invention wherein heat within the enclosure is delivered into the room within which the fireplace is situated.
Figure 10:
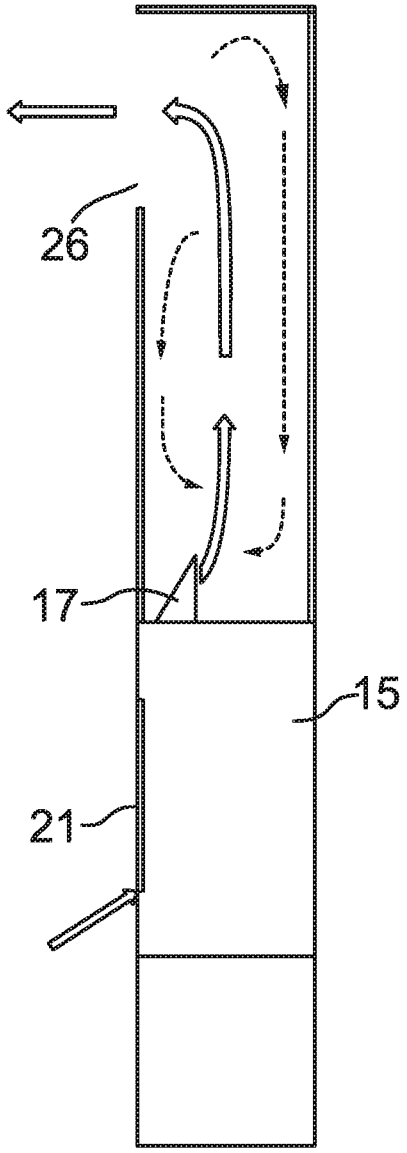

Heat that exits upper end 13 of chimney 11 and is directed by airflow guides 17 will tend to rise upwardly within framed enclosure 15. In one embodiment, vents or openings 26 within the upper portion of framed enclosure 15 are created in order to allow rising heat to escape into the room, above the appliance. Directing heat generated by fireplace 1 in this manner not only helps to serve to maintain the temperature of glass panes 19, 20 and 21 within a desired range, but also helps to reduce the heating effect upon combustible materials from which framed enclosure 15 may be formed. Further, unlike traditional fireplaces that tend to direct a significant amount of heat into the room at a position immediately adjacent to the top of the exposed portion of the fireplace, the described invention directs at least a portion of the heat that is generated into enclosure 15 in a manner that helps to minimize over heating of temperature sensitive objects that may be mounted above the fireplace. Not only is the redirection of heat in this manner advantageous from the perspective of permitting the mounting of objects above a fireplace that might not otherwise be possible, it can also have the effect of reducing the cost of installation and enhancing the aesthetic opportunities available to an installer. That is, through directing heat away from combustible materials from which framed enclosure 15 may be formed, the need for non-combustible materials immediately adjacent to the upper surface of the fireplace can be eliminated or minimized. Further, in some instances the level of comfort of individuals within the room and in close proximity to the fireplace may be enhanced by reducing the amount of heat that is delivered immediately adjacent to the front of the fireplace. FIGS. 8, 9 and 10 demonstrate schematically how air flows through fireplace 1 and through enclosure 15 in an embodiment of the invention that directs heat from the enclosure back into the room where the fireplace is situated. In some instances vents may also be incorporated into framed enclosure 15 to allow heated air to flow from enclosure 15 into adjacent rooms or rooms immediately above that within which the fireplace is installed.

In the case of fireplaces that are installed in warm climates, operation of a fireplace is often for purposes of aesthetics. In such cases the present invention permits heat generated from the fireplace to rise upwardly through framed enclosure 15 and be directed through vents 27 or duct work 28 to the exterior of a building or elsewhere where heating of the room within which the fireplace is situated is not desired. In still further embodiments, dampers and/or blowers 29 may be incorporated into the fireplace and/or framed enclosure 15 in order to further direct heated air rising from upper end 13 of chimney 11 to an alternate room or the exterior of the building.

Figure 11:
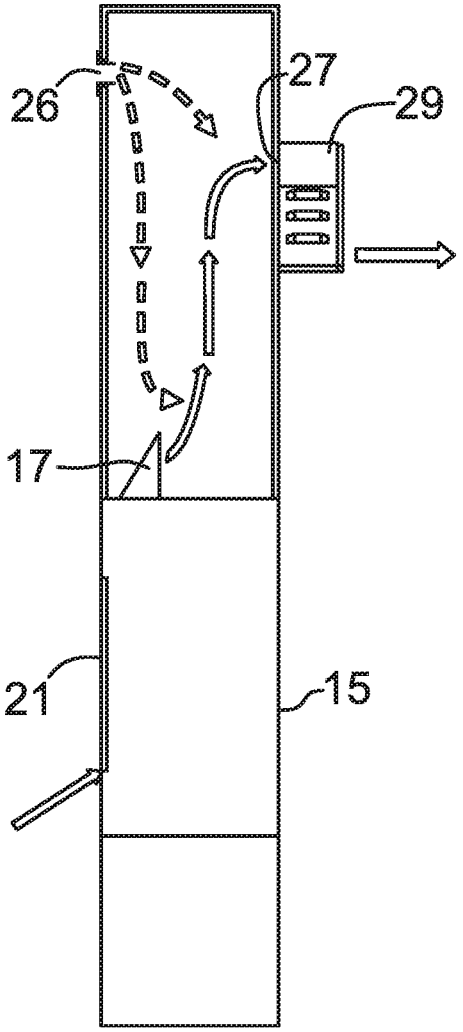
FIG. 11 demonstrates schematically the air flow through a framed enclosure housing a fireplace employing an embodiment of the present invention wherein heat within the enclosure and heat from the room within which the fireplace is situated is expelled to a different room or to a building exterior.

FIG. 11 shows schematically how air may be drawn or allowed to flow from within enclosure 15 to an exterior location. In this embodiment a blower or damper 29 may be utilized to control the flow of air or enhance air movement. In addition, and as shown, if desired room air can be drawn into enclosure 15 through vent 26 and then subsequently expelled through vent 27.

Figure 12:
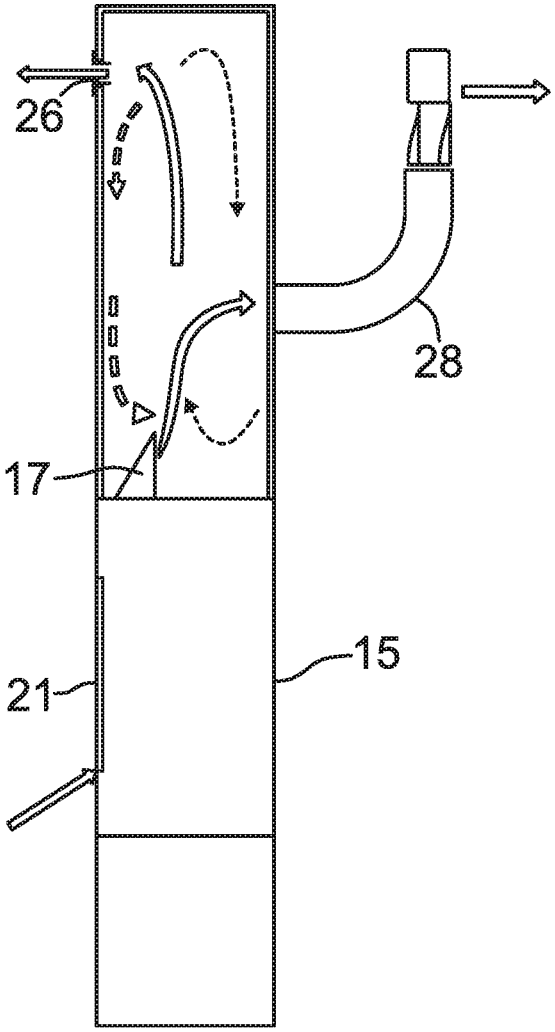
FIG. 12 demonstrates schematically the air flow through a framed enclosure housing a fireplace employing an embodiment of the present invention wherein heat within the enclosure is directly delivered to the room within which the fireplace is situated and is also expelled to a different location within the room that the fireplace is located, or a different room or to a building exterior.

FIG. 12 shows schematically how air may be drawn or allowed to flow from within enclosure 15 to an exterior location through use of a dedicated duct 28 that may or may not include a blower. Further, the particular embodiment depicted also demonstrates how a portion of the heated air within enclosure 15 can be directed to an exterior or remote location with a portion also being delivered through vent 26 back to the room within which the fireplace is situated.

Accordingly, from a thorough understanding of the above described structure, it will be appreciated that there is provided a mechanism that permits room air drawn along a pre-determine side or surface of a fireplace or appliance to be heated and to then be directed to a chimney, which in turn causes an enhanced draw of room air. It has been found that through capturing heat from both the viewing pane or panes of the appliance (or a screen or side panel as the case may be), and through also capturing heat from the top of the appliance, the entrained air can be heated to a degree that tends to amplify the chimney effect created within chimney 11, to thereby enhancing the draw of air along the viewing pane, screen or side panel. This enhanced draw may help to cool or maintain the temperature of the viewing pane or screen within a desired range. In an embodiment that uses three viewing panes, a pair of generally parallel air flow passages is created through which room air is drawn by the chimney effect created within chimney 11. The heat generated at the top of the appliance, captured by first air duct 10 and directed to chimney 11, serves to help increase the draw through the pair of air flow passages. It has been found that no fan or other such mechanism is required to achieve the desired airflow or the desired cooling effect.

It has been discovered that through the unique structure set out above, outer or exterior viewing pane 21 may be kept at a temperature in compliance with local regulations. Further, since no electrical fan is utilized the exterior viewing pane of the fireplace is kept cool in situations where no electrical power is present. This presents significant safety advantages in the operation of appliances in remote locations or where a disruption in the power supply has occurred.

The ability to direct heat away from the combustible materials from which framed enclosure 15 is formed is an added advantage that can reduce cost, enhance safety, and permit the mounting of temperature sensitive objects immediately above the front surface of the appliance. It has further been discovered that utilization of the above described structure may permit a relatively shallow appliance to be created, while at the same time maintaining the temperature of the viewing pane and preventing the enclosure immediately above the appliance from being heated to an excessive degree. Whereas previously in many instances an appliance needed to be relatively deep in order to situate the burner at the back of the appliance so as to keep the heat away from the framing forming the enclosure, the inventors have determined that the present invention permits for a shallower appliance to be installed that is significantly less intrusive into the room environment. The ability of the current invention to effectively re-direct heat emanating from the firebox of the appliance, and its viewing panes or exterior panel, upwardly and away from the front of the appliance permits the use of non-combustible materials both adjacent to and above front portions of the appliance, providing both installation advantages and the ability to locate temperature sensitive equipment and finishes close to the appliance.

It is to be understood that what has been described are the preferred embodiments of the invention and that other embodiments are possible. For example, while the appliance shown in the attached drawings is a direct vent fireplace, one skilled in the art will understand that the invention could equally be applied to a natural vented fireplace, to a wood or other form of stove, to a non-vented fireplace or stove, or to a variety of other forms and configurations of appliances. Further, in some cases there may not be a desire for the appliance to have incorporated into it a viewing window or pane, in which case the air flow passages 22/23 may be formed between adjacent, opaque, side panels. That is, in such instances the appliance may include metal plates that effectively serve the same function in terms of directing air flow as do the viewing pane or viewing panes described above. In a still further embodiment, three, four or more viewing panes, screen and/or side panels may be positioned side by side to create two, three or more separate air flow passages.

The scope of the claims should not be limited by the preferred embodiments set forth above, but should be given the broadest interpretation consistent with the description as a whole.

We claim:

1. An appliance comprising:

a firebox having a top, a bottom and a plurality of side surfaces, at least one of said side surfaces including at least one of a viewing pane, a screen, or a side panel;

a first air duct in fluid communication with at least a portion of said top surface of said firebox, said first air duct defined in part by at least a portion of said top surface of said firebox; and a room air chimney in fluid communication with said first air duct and extending along at least part of the length of the firebox, the chimney having at least a partially open lower end and at least a partially open upper end with enclosed sides extending therebetween, at least a portion of said lower end in fluid communication with one or both of said first air duct and heated room air adjacent to said at least one viewing pane, screen, or side panel such that heated air within said first air duct rises and is received within said chimney and heated air adjacent to said at least one viewing pane, screen, or side panel rises and is received within (i) said first air duct and then said chimney, or (ii) directly into said chimney, wherein, during operation of said appliance heated air adjacent to said at least one viewing pane, screen, or side panel, and heated room air from said first air duct, is received within said chimney, said heated air within said chimney rising toward said open upper end causing said chimney to draw additional air from adjacent to said at least one viewing pane, screen or side panel and into said first air duct wherein the rising of the heated air within said chimney is caused only by convection of the heated air, and wherein the appliance is positioned within an enclosure, the enclosure including one or more vents positioned above the appliance to permit heated air rising within the enclosure to escape the enclosure without reporting to an exhaust gas stream of the appliance.

2. The appliance as claimed in claim 1 wherein said at least one viewing pane, screen or side panel comprise an inner and an outer viewing pane forming a first air flow passage therebetween, said first air flow passage open at a bottom end to room air, said first air flow passage having an upper end in fluid communication with one or both of said first air duct and said chimney.

3. The appliance as claimed in claim 2 further including a baffle mounted above said inner and outer viewing panes and extending along the length of said firebox, said baffle having an inner edge and an outer edge, said outer viewing pane having an upper portion sealed to said outer edge of said baffle, said inner edge of said baffle terminating in said first air duct such that said baffle directs air flowing upwardly through said first air flow passage into said first air duct.

4. The appliance as claimed in claim 2 wherein said inner and outer viewing panes converge in a direction toward said upper end of said first air flow passage such that the cross sectional area of said first air flow passage decreases in a direction toward its upper end.

5. The appliance as claimed in claim 2 having a third viewing pane, where said inner, outer and third viewing panes form a first and a second air flow passage.

6. The appliance as claimed in claim 1 wherein said upper end of said chimney includes one or more air flow guides directing air rising from said upper end of said chimney in a direction away from the plane of said at least one viewing pane, screen, or side panel.

7. The appliance as claimed in claim 6 wherein said air flow guides direct heated air expelled through said upper end of said chimney away from exterior walls of said enclosure.

8. The appliance as claimed in claim 1 wherein said enclosure is situated within a room of a building.

9. The appliance as claimed in claim 8 including a moveable damper to selectively direct heated air from within said enclosure to either the room within which the appliance is situated or to one or more locations exterior to said room.

10. The appliance as claimed in claim 1 wherein said enclosure includes ducts or passageways to direct heated air rising from said chimney to one or more rooms or areas, or to the exterior of a building within which the enclosure is situated.

11. The appliance as claimed in claim 1 having a room air chimney, together with a first air duct, positioned on each of two or more sides of said appliance.

12. The appliance as claimed in claim 1 wherein one or more of said enclosed sides of said chimney are insulated to reduce heat transmission from said chimney.

13. The appliance as claimed in claim 1 wherein said at least one viewing pane, screen or side panel comprises two or more viewing panes forming one or more air flow passages therebetween, one or more of said viewing panes sloped such that the associated air flow passage narrows in a direction toward its upper end.

14. The appliance as claimed in claim 1 wherein a portion of said enclosure is positioned above said first air duct and comprises said chimney.

15. A method to cool an exposed surface of an appliance having a firebox with a top, bottom and a plurality of side surfaces, at least one side surface enclosed by a first viewing pane having a second viewing pane located a predetermined distance from the first viewing pane forming a first air flow passage between said viewing panes, the method comprising:

during operation of the appliance, heating the top surface of the firebox to cause a resulting heating of air in a first air duct in fluid communication with the top surface of the fireplace;

directing heated air rising under the influence of gravity within the first air duct to a room air chimney in fluid communication with the first air duct and extending along at least part of the length of the firebox;

drawing room air through the first air flow passage into (i) the first air duct and then subsequently into the chimney, or (ii) directly into the chimney; and utilizing heat extracted from the viewing panes by passing air through the first air flow passage and utilizing heat extracted by air passing through said first air duct to accelerate the flow of air through the chimney thereby generating a chimney effect to enhance the draw of air through the first air flow passage wherein the chimney effect includes rising of the air within said chimney caused only by convection of the air, and wherein the appliance is positioned within an enclosure, the enclosure including one or more vents positioned above the appliance to permit heated air rising within the enclosure to escape the enclosure without reporting to an exhaust gas stream of the appliance.

16. The method as claimed in claim 15 including the further step of expelling air from the top of the chimney and, through the use of one or more air flow guides, directing the expelled air toward a position vertically above a central portion of the fire box.

17. The method as claimed in claim 15 further comprising directing heated air from the air flow guides through a duct that transmits the heated air to a room, or to the exterior of a building within which the enclosure is situated.

18. A direct vent fireplace or stove comprising:

a firebox having a top, a bottom and a plurality of side surfaces, at least one of said side surfaces comprising a transparent first viewing pane;

a second viewing pane set off from said first viewing pane and defining a first air flow passage between said viewing panes;

a first air duct in communication with at least a portion of said top surface of said firebox, said first air duct defined in part by said top surface of said firebox and in fluid communication with said first air flow passage; and a room air chimney in fluid communication with said first air duct and extending along at least part of the length of the firebox, the chimney having at least a partially open lower end and at least a partially open upper end with enclosed sides extending therebetween, at least a portion of said lower end in fluid communication with one or both of said first air duct and said first air flow passage such that heated air within said first air flow passage rises and is received within (i) the first air duct and then the chimney, or (ii) directly into the chimney, wherein, during operation of said appliance heated air from said first air flow passage is received in said first air duct and heated air from said first air duct is received within said chimney, said heated air within said chimney rising toward said open upper end and causing said chimney to draw additional air through said first air flow passage wherein the rising of the heated air within said chimney is caused only by convection of the heated air, and wherein the fireplace or stove is positioned within an enclosure, the enclosure including one or more vents positioned above the fireplace or stove to permit heated air rising within the enclosure to escape the enclosure without reporting to an exhaust gas stream of the fireplace or stove.

19. The fireplace or stove as claimed in claim 18 wherein said chimney has positioned at an upper end thereof one or more air flow guides directing heated air expelled through said chimney away from exterior walls of the enclosure.

20. The fireplace or stove as claimed in claim 19 further including a baffle mounted above said first and second viewing panes and running along the length of said firebox, said baffle having an interior edge and an outer edge, said second viewing pane having an upper portion sealed to said outer edge of said baffle, said interior edge of said baffle terminating in said first air duct such that said baffle directs air flowing upwardly, from said first air flow passage into said first air duct, into said chimney.

21. An appliance comprising:

a firebox having a top, a bottom and a plurality of side surfaces, at least one of said side surfaces including at least one of a viewing pane, a screen, or a side panel;

a first air duct in communication with at least a portion of said top surface of said firebox, said first air duct isolated from gases within said firebox and having a lower portion defined in part by said top surface of said firebox, said first air duct further having an upper surface defined by a plate with at least one opening therein to permit heated air within said first air duct to rise and escape at a defined location, said lower portion of said first air duct including at least one opening to permit heated air rising and flowing along said at least one viewing pane, screen or side panel into enter said first air duct, wherein, in operation said appliance is situated within a framed enclosure within in a room, wherein that portion of said framed enclosure positioned above said first air duct comprises a room air chimney such that heated air within said first air duct rises, passes through said opening in said plate and into said room air chimney, and wherein, during operation of said appliance heated air adjacent to said at least one viewing pane, screen, or side panel, and heated air from said first air duct, is received within the framed enclosure, said heated air within the framed enclosure rising upward within the enclosure creating a chimney effect resulting in a draw of additional air from adjacent to said at least one viewing pane, screen or side panel and into the framed enclosure wherein the rising of the heated air within said chimney is caused only by convection of the heated air, and wherein the appliance is positioned within an enclosure, the enclosure including one or more vents positioned above the appliance to permit heated air rising within the enclosure to escape the enclosure without reporting to an exhaust gas stream of the appliance.

* * * * *